US006796094B1

(12) United States Patent
Kelemen

(10) Patent No.: US 6,796,094 B1
(45) Date of Patent: Sep. 28, 2004

(54) MORTARLESS CONCRETE WALL SYSTEM

(76) Inventor: Dionisie Kelemen, 81 Charles Street E., Toronto, Ontario (CA), M4Y-1V2

( * ) Notice: Subject to any disclaimer, the term of this patent is extended or adjusted under 35 U.S.C. 154(b) by 1 day.

(21) Appl. No.: 10/284,522

(22) Filed: Oct. 30, 2002

(51) Int. Cl.[7] ..... E04C 1/00

(52) U.S. Cl. ..... 52/309.8; 52/309.11; 52/404.1; 52/425; 52/426; 52/513; 52/562; 52/90; 405/284; 405/286; 405/262

(58) Field of Search ..... 52/309.8, 309.11, 52/404.1, 425, 426, 513, 562, 90; 405/284, 286, 262

(56) References Cited

U.S. PATENT DOCUMENTS 903,907 A * 11/1908 Soss ..... 52/592.3
1,365,162 A * 1/1921 Ferguson ..... 52/591.2
1,552,077 A * 9/1925 Palanti ..... 52/286
2,994,162 A * 8/1961 Frantz ..... 52/592.5
3,305,982 A * 2/1967 Steele ..... 52/90.1
3,609,926 A * 10/1971 Muse ..... 52/439
3,641,731 A * 2/1972 Winfree ..... 52/747.12
3,888,055 A * 6/1975 Gallo ..... 52/98
3,936,987 A * 2/1976 Calvin ..... 52/309.1
3,966,339 A * 6/1976 Nemecek et al. ..... 403/292
4,035,975 A 7/1977 Gergely
4,110,949 A * 9/1978 Cambiuzzi et al. ..... 52/437
4,312,606 A 1/1982 Sarikelle
4,341,050 A * 7/1982 Long ..... 52/591.2
4,454,699 A * 6/1984 Strobl ..... 52/585.1
4,512,685 A 4/1985 Hegle
4,523,415 A * 6/1985 Rosen ..... 52/220.2
4,651,485 A * 3/1987 Osborne ..... 52/284
4,660,342 A * 4/1987 Salisbury ..... 52/358
4,833,856 A * 5/1989 Zwagerman ..... 52/592.1
4,884,921 A * 12/1989 Smith ..... 405/286
4,888,931 A * 12/1989 Meilleur ..... 52/426
4,947,610 A * 8/1990 Koerner ..... 52/585.1
4,956,958 A * 9/1990 Caroti ..... 52/605
5,098,328 A * 3/1992 Beerens ..... 446/128
5,104,598 A 4/1992 Dolle
5,140,794 A * 8/1992 Miller ..... 52/309.12
5,178,492 A * 1/1993 Meheen ..... 405/284
5,186,883 A * 2/1993 Beall, III ..... 264/275
5,230,191 A 7/1993 Mayrand
5,454,200 A * 10/1995 Hohmann ..... 52/513
5,459,970 A * 10/1995 Kim ..... 52/424
5,566,517 A * 10/1996 Ishii et al. ..... 52/387
5,671,578 A * 9/1997 Hohmann ..... 52/562
5,704,180 A * 1/1998 Boeck ..... 52/426
5,709,062 A * 1/1998 Woolford ..... 52/604
5,771,650 A * 6/1998 Williams et al. ..... 52/568
5,787,666 A 8/1998 Sherry
5,802,797 A 9/1998 Storer-Folt
5,826,394 A * 10/1998 Barton et al. ..... 52/592.1
5,845,445 A * 12/1998 Blackbeard ..... 52/426
5,906,456 A * 5/1999 Knight ..... 405/20
6,209,281 B1 * 4/2001 Rice ..... 52/714
6,321,497 B1 * 11/2001 Cormier ..... 52/425
6,439,571 B1 * 8/2002 Wilson ..... 273/157 R
6,488,448 B1 * 12/2002 Blomquist et al. ..... 405/284

* cited by examiner

*Primary Examiner*—Carl D. Friedman
*Assistant Examiner*—Christy Green
(74) *Attorney, Agent, or Firm*—Richard L. Miller

(57) ABSTRACT

A mortarless concrete wall system. An insulation panel is connected to a brick by a connector. The insulation panel is spaced inwardly from the brick so as to form a space therebetween that is filled with concrete. The brick includes a plurality of bulbous projections, a first plurality of blind bores, a second plurality of blind bores, and a plurality of alignment pins that are received in the first plurality of blind bores in an associated brick and in the second plurality of blind bores in a brick of a next upper course. The insulation panel has a plurality of dove tail slots for plaster to grip, a dove tail slot, a dove tail projection received in the dove tail slot of an insulation panel in a lower adjacent course. The connector includes a pair of end pieces, a center piece, a pair of intermediate pieces, and an end cap.

14 Claims, 4 Drawing Sheets

MORTARLESS CONCRETE WALL SYSTEM

BACKGROUND OF THE INVENTION

1. Field of the Invention

The present invention relates to a wall system. More particularly, the present invention relates to a mortarless concrete wall system.

2. Description of the Prior Art

Numerous innovations for wall systems have been provided in the prior art that will be described. Even though these innovations may be suitable for the specific individual purposes to which they address, however, they differ from the present invention.

A FIRST EXAMPLE, U.S. Pat. No. 4,035,975 to Gergely teaches a wall of building blocks, each block being in the form of a parallelepipedon having corrugated or sawtooth shaped upper and lower surfaces, the corrugations or teeth of one surface extending perpendicular to the corrugations or teeth of the other. Two opposite ends of the block may be provided with parallel ribs and slots in asymmetric relation so that when two such blocks are arranged end-to-end a slot in each block accommodates a rib of the other block. Sore blocks may have one flat end and a slot in one of its sides to accommodate the rib of another block when the two blocks are arranged to form a corner. All the blocks have cavities extending completely through them. A plurality of such blocks can be arranged end-to-end and one above the other, with the corrugations or sawteeth of each block meshing with the corrugations or sawteeth of another, to form a wall, and mortar or concrete is then poured into all the aligned cavities of the blocks.

A SECOND EXAMPLE, U.S. Pat. No. 4,312,606 to Sarikelle teaches a prefabricated retaining wall system wherein a number of basic components of various shapes and sizes are capable of being assembled in several different arrangements to form a vertical face or sloped face wall, a vertical face or sloped face wall with deadman anchors, a crib or bin type wall, all of which have interlocking parts and post like members which interconnect the components to form an integral wall system which resists sliding and overturning.

A THIRD EXAMPLE, U.S. Pat. No. 4,512,685 to Hegle teaches a building block made of concrete or the like that comprises a front face, a back face, a top face, a bottom face, and a pair of side faces. The top face has a convex angular first surface with a vertex extending between the side faces, and a concave angular second surface with a vertex extending between the side faces. The concave second surface lies between the convex first surface and the front face of the block. The bottom face has a concave angular third surface with a vertex extending between the aide faces, and a convex angular fourth surface with a vertex extending between the side faces. The convex fourth surface lies between the concave third surface and the front face. The convexity of the first and fourth surfaces matches the concavity of the third and second surfaces, respectively, thereby forming a double interlock, namely, an interlock between the first and third surfaces and a interlock between the second and fourth surfaces. A mortarless retaining-wall system is made from the described blocks stacked one on top of the other to form a plurality of upright spaced-apart columns and a plurality of stacked beams extending between each pair of adjacent columns. The ends of the beams are held between the respective blocks of the columns.

A FOURTH EXAMPLE, U.S. Pat. No. 5,104,598 to Dolle teaches a light-weight fiber brick that is formed from a water-fiber suspension including ceramic fibers. A molding device is introduced into the suspension and has plurality walls including at least three walls each of which extends perpendicular to the other two of the three walls. Water is withdrawn simultaneously from the interior of the molding device through at least the three walls, thus causing the fibers of the suspension to tend to align longitudinally within the interior of the molding device in three spatial coordinate directions (X, Y, Z). Thereby there is formed a brick having fibers thereof aligned with longitudinal directions thereof having directional components in three spatial coordinate directions.

A FIFTH EXAMPLE, U.S. Pat. No. 5,230,191 to Maryrand teaches a precast insulated concrete panel and a method of forming same and a building structure incorporating such panel. The precast insulated concrete panel is comprised of an outer insulating skin formed by a rigid layer of insulating sheet foam material connected to a concrete inner wall layer cast on the inner surface of the insulating material. The inner surface of the insulating material has connecting cavities formed therein so that the concrete flows into the cavity and connects to the rigid insulating material through integral plugs of concrete which are set formed with the connecting cavities. Connectors are also formed in the concrete and in the insulation to connect and manipulate the panels and to attach outer finishing building materials to the insulation. These panels may be utilized in a tilt-up construction method and connect to floor slabs to form building structures of more than one story.

A SIXTH EXAMPLE, U.S. Pat. No. 5,787,666 to Sherry teaches a system of light weight, high strength, thin masonry panels having one or more mateable seam hiding edges. The seam hiding edge may be serpentine or some other shape consistent with the masonry element chosen for the panel surface. The aforementioned thin masonry panels are used to construct patio or walkway surfaces as well as provide a decorative facing for walls, fireplaces, and the like. The thickness of the panels is limited to the range of 1 to 2 inches in order to assure a light weight for ease of construction. Each panel is a reinforced series of masonry elements such as stone or brick pavers bound together by a cement or mortar-like material. The claimed invention also includes an attachment plate for affixing the panels to other surfaces and structures.

A SEVENTH EXAMPLE, U.S. Pat. No. 5,802,797 to Storer-Folt teaches a masonry system in which specially shaped brick are dry-stacked and subsequently bonded by pouring mortar or grout into apertures in the brick to flow through the stacked structure to surround the individual brick leaving the front and rear faces exposed. The brick have alignment projections extending from the bottom bed faces which register with alignment grooves in the top bed faces of the lower brick to align the upper brick prior to bonding. The projections and grooves define a recess to admit mortar between adjacent brick faces. The brick also have recesses in the header faces to admit mortar between adjacent header faces. The front faces of the brick are contoured to create the appearance of mortar joints when the brick are stacked. The brick may be manufactured by extrusion, wire cutting and final shaping using suitable blades to achieve the desired finished shape. If desired, certain apertures through the brick may be covered over using a suitably shaped blade operating under appropriate conditions.

It is apparent that numerous innovations for wall systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a mortarless concrete wall system that avoids the disadvantages of the prior art.

ANOTHER OBJECT of the present invention is to provide a mortarless concrete wall system that is simple to use.

BRIEFLY STATED, STILL ANOTHER OBJECT of the present invention is to provide a mortarless concrete wall system. An insulation panel is connected to a brick by a connector. The insulation panel is spaced inwardly from the brick so as to form a space therebetween that is filled with concrete. The brick includes a plurality of bulbous projections, a first plurality of blind bores, a second plurality of blind bores, and a plurality of alignment pins that are received in the first plurality of blind bores in an associated brick and in the second plurality of blind bores in a brick of a next upper course. The insulation panel has a plurality of dove tail slots for plaster to grip, a dove tail slot, a dove tail projection received in the dove tail slot of an insulation panel in a lower adjacent course. The connector includes a pair of end pieces, a center piece, a pair of intermediate pieces, and an end cap.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
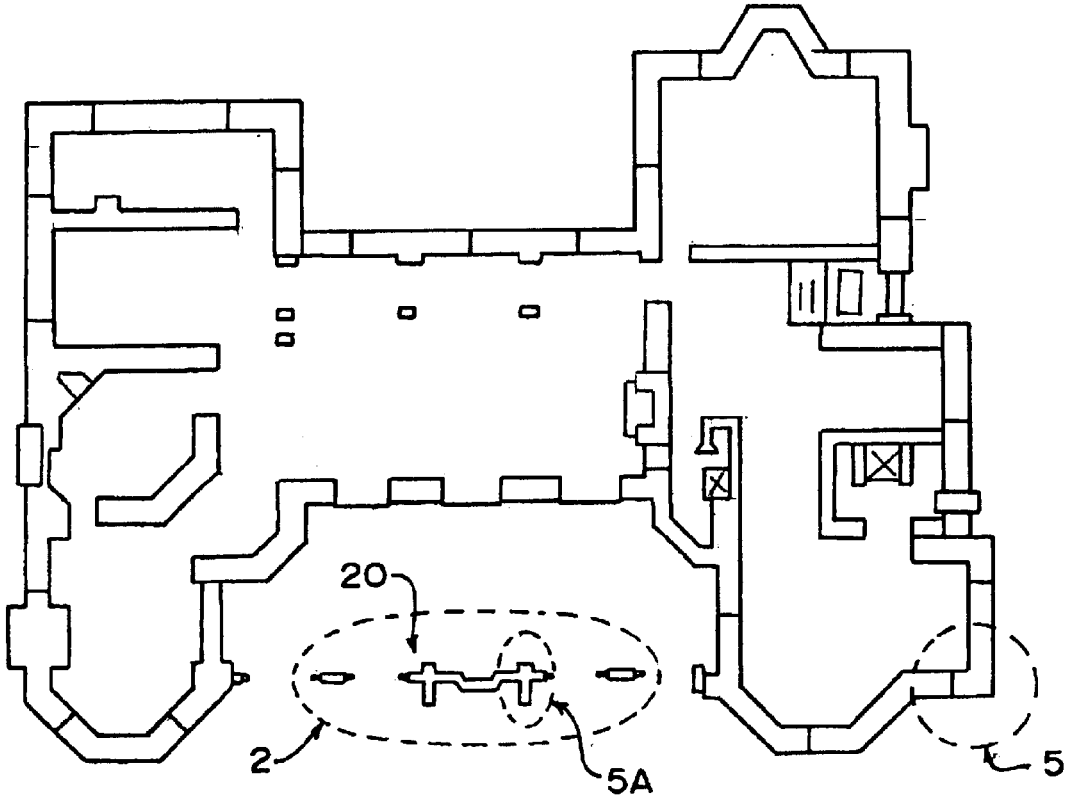
FIG. 1 is a diagrammatic top plan view of a building incorporating the present invention.

20 mortarless concrete wall system of present invention
22 at least one brick
24 at least one insulation panel
26 at least one connector
28 space for filling with concrete 30
30 concrete
32 exterior side surface of each brick of at least one brick 22
34 top surface of each brick of at;least one brick 22
35 bottom surface of each brick of at least one brick 22
36 pair of end surfaces of each brick of at least one brick 22
38 interior side surface of each brick of at least one brick 22
40 plurality of bulbous projections on interior side surface 38 of each brick of at least one brick 22
42 necks of plurality of bulbous projections 40 on interior side surface 38 of each brick of at least one brick 22, respectively
44 heads of plurality of bulbous projections 40 on interior side surface 38 of each brick of at least one brick 22, respectively
46 recesses between necks 42 of adjacent projections of plurality of bulbous projections 40 on interior side surface 38 of each brick of at least one brick 22, respectively
48 plurality of blind bores in top surface 34 of each brick of at least one brick 22
50 plurality of blind bores in bottom surface 35 of each brick of at least one brick 22
52 plurality of alignment pins of each brick of at least one brick 22
54 body portion of each alignment pin of plurality of alignment pins 52 of each brick of at least one brick 22
56 head portion of each alignment pin of plurality of alignment pins 52 of each brick of at least one brick 22
58 plurality of rings extending circumferentially around body portion 54 of each alignment pin of plurality of alignment pins 52 of each brick of at least one brick 22
60 plurality of rings extending circumferentially around head portion 56 of each alignment pin of plurality of alignment pins 52 of each brick of at least one brick 22
62 exterior side surface of each insulation panel of at least one insulation panel 24
64 top surface of each insulation panel of at least one insulation panel 24
65 bottom surface of each insulation panel of at least one insulation panel 24
66 pair of end surfaces of each insulation panel of at least one insulation panel 24

68 interior side surface of each insulation panel of at least one insulation panel 24

70 plurality of dove tail slots in interior side surface 68 of each insulation panel of at least one insulation panel 24 for plaster 71 applied to interior side surface 68 of each insulation panel of at least one insulation panel 24 to grip.

72 dove tail slot in top surface 64 of each insulation panel of at least one insulation panel 24

74 dove tail projection on bottom surface 65 of each insulation panel of at least one insulation panel 24

76 plurality of raised panels on exterior side surface 62 of each insulation panel of at least one insulation panel 24

78 criss-crossed recesses between plurality of raised panels 76 on exterior side surface 62 of each insulation panel of at least one insulation panel 24 for concrete 30 to grip

80 pair of end pieces of connector 26

82 center piece of connector 26

84 pair of intermediate pieces of connector 26

86 blind bore in each end piece of pair of end pieces 80 of each connector 26

88 legs of center piece 82 of each connector 26 for receiving rebar 90

90 rebar

92 dove tail projection/slot at one end of center piece 82 of each connector 26

94 dove tail slot/projection at other end of center piece 82 of each connector 26

96 legs of each intermediate piece of pair of intermediate pieces 84 of each connector 26 for receiving rebar 98

98 rebar

100 dove tail slot/projection 100 at one end of each intermediate piece of pair of intermediate pieces 84 of each connector 26

102 male coupling on other end of each intermediate piece of pair of intermediate pieces 84 of each connector 26

104 end cap of each connector of at least one connector 26

105 base of end cap 104 of each connector of at least one connector 26

106 head of end cap 104 of each connector of at least one connector 26

DETAILED DESCRIPTION OF THE PREFERRED EMBODIMENT

Figure 2:
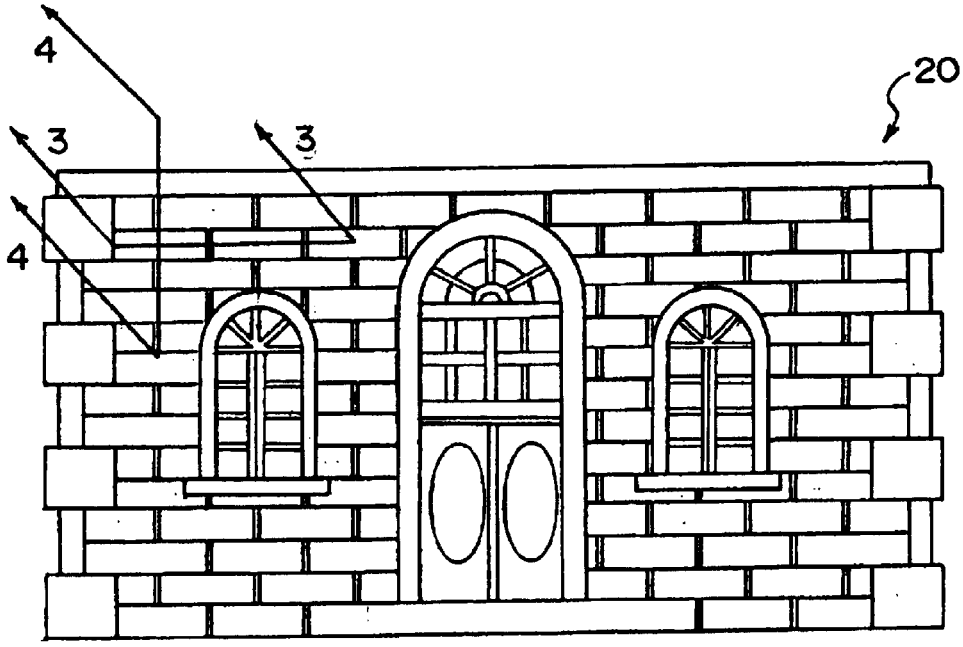
FIG. 2 is an enlarged diagrammatic front elevational view of the area generally enclosed by the dotted curve identified by arrow 2 in FIG. 1 of a wall incorporating the present invention.

Referring now to the figures, in which like numerals indicate like parts, and particularly to FIGS. 1 and 2, the mortarless concrete wall system of the present invention is shown generally at 20.

Figure 4:
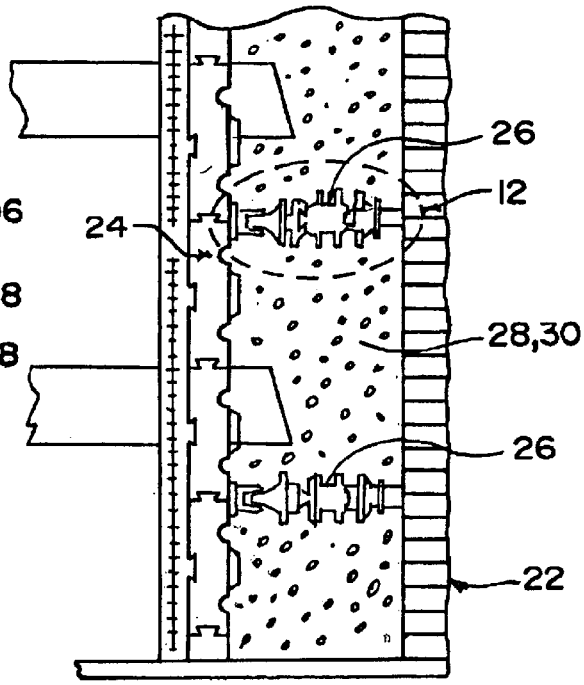
FIG. 4 is an enlarged diagrammatic cross sectional view taken along line 4—4 in FIG. 2.
Figure 3:
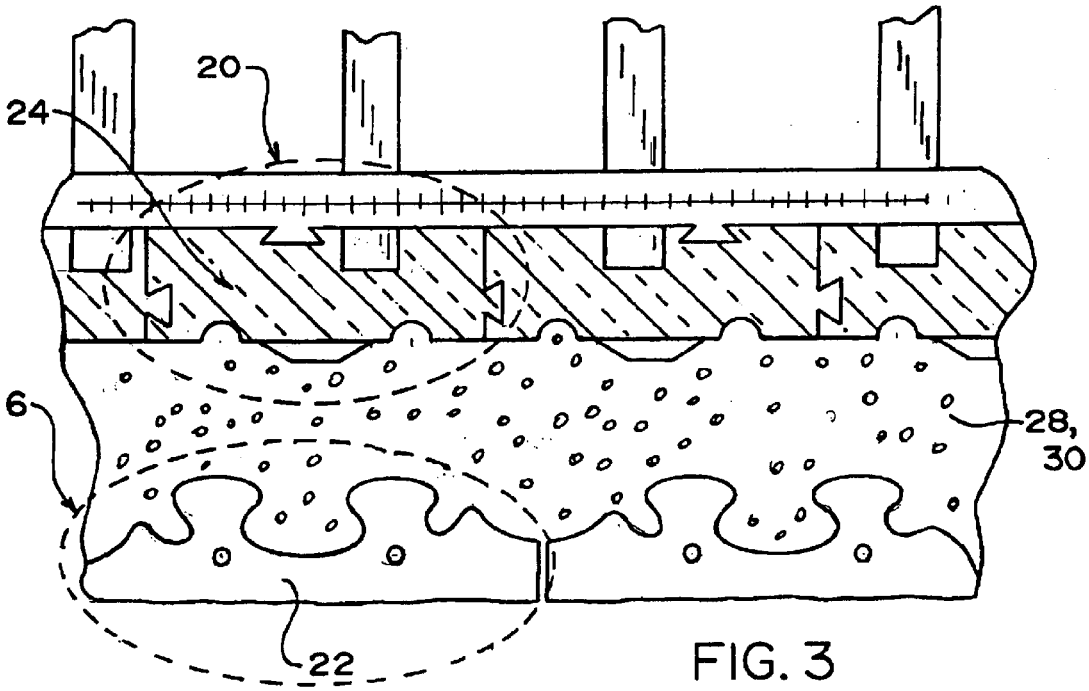
FIG. 3 is an enlarged diagrammatic cross sectional view taken along line 3—3 in FIG. 2.
Figure 5A:
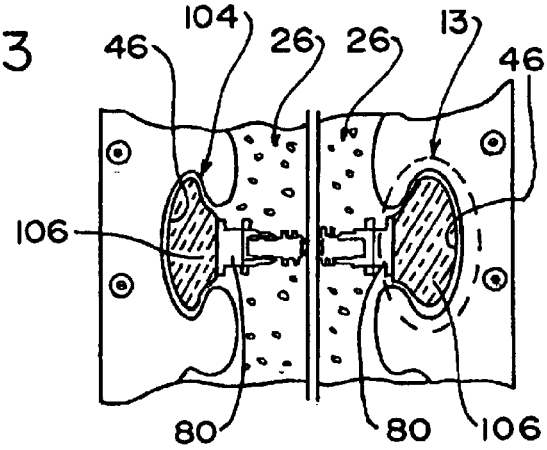
FIG. 5A is an enlarged diagrammatic cross sectional view of the area generally enclosed by the dotted curve identified by arrow 5A in FIG. 1 of a double wall incorporating the present invention.
Figure 5:
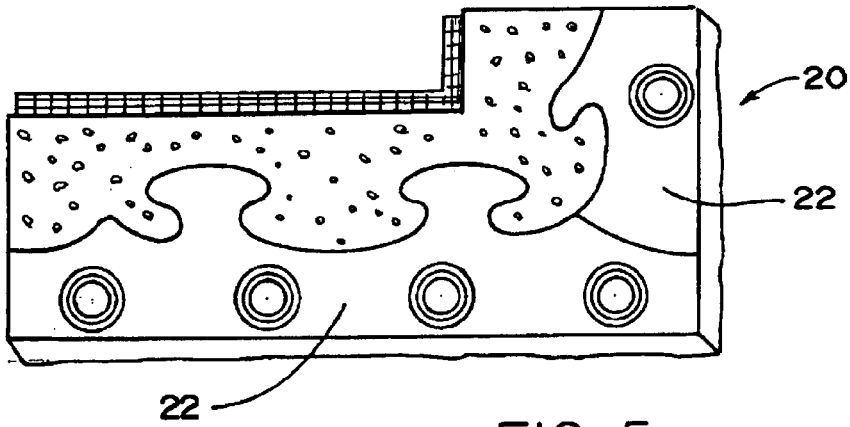
FIG. 5 is an enlarged diagrammatic cross sectional view of the area generally enclosed by the dotted curve identified by arrow 5 in FIG. 1 of a corner incorporating the present invention.
Figure 6:
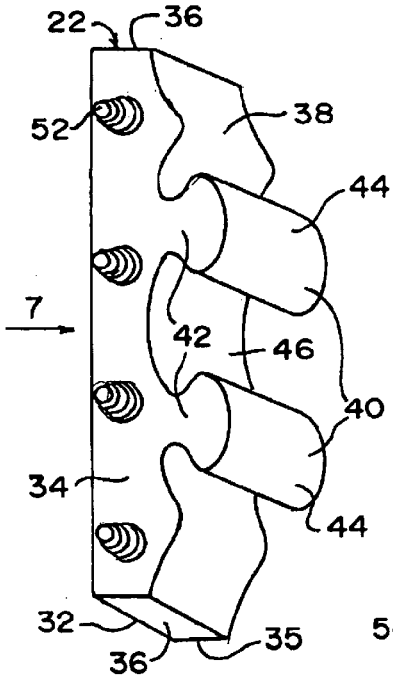
FIG. 6 is a diagrammatic perspective view of the area generally enclosed by the dotted curve identified by arrow 6 in FIG. 3 of a brick of the present invention.
Figure 8:
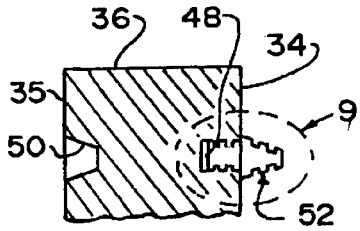
FIG. 8 is an enlarged diagrammatic cross sectional view taken along line 8—8 in FIG. 7.
Figure 9:
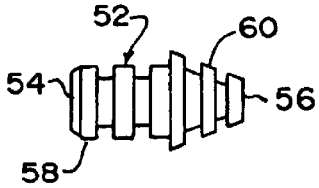
FIG. 9 is an enlarged diagrammatic elevational view of the area generally enclosed by the dotted curve identified by arrow 9 in FIG. 8 of an alignment pin of the present invention.
Figure 7:
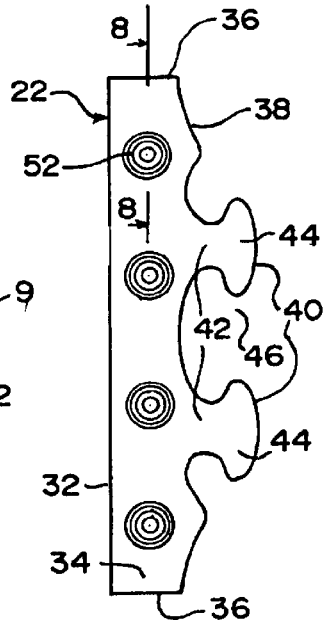
FIG. 7 is a diagrammatic side elevational view taken generally in the direction of arrow 7 in FIG. 6.

The overall configuration of the mortarless concrete wall system 20 can best be seen in FIGS. 3–5, and as such, will be discussed with reference thereto.

The mortarless concrete wall system 20 comprises at least one brick 22, at least one insulation panel 24, and at least one connector 26. The at least one insulation panel 24 is connected to the at least one brick 22 by the at least one connector 26 and spaced inwardly from the at least one brick 22 so as to form a space 28 therebetween for filling with concrete 30.

The specific configuration of each brick 22 can best be seen in FIGS. 6–9, and as such, will be discussed with reference thereto.

Each brick 22 has an exterior side surface 32, a top surface 34, a bottom surface 35, a pair of end surfaces 36, and an interior side surface 38. The exterior side surface 32 of each brick 22, the top surface 34 of each brick 22, the bottom surface 35 of each brick 22, and the pair of end surfaces 36 of each brick 22 are planar, while the interior side surface 38 of each brick 22 is not planar.

The interior side surface 38 of each brick 22 comprises a plurality of bulbous projections 40. The plurality of bulbous projections 40 on the interior side surface 38 of each brick 22 project therefrom by necks 42 that terminate in heads 44. The necks 42 of the plurality of bulbous projections 40 of the interior side surface 38 of each brick 22 are concave and the heads 44 of the plurality of bulbous projections 40 of the interior side surface 38 of each brick 22 are convex and wider than the necks 42 of the plurality of bulbous projections 40 on the interior side surface 38 of each brick 22 so as to form recesses 46 between the necks 42 of adjacent bulbous projections 40 on the interior side surface 38 of each brick 22 that are concave and into which the heads 44 of the plurality of bulbous projections 40 on the interior side surface 38 of each brick 22 impinge so as to form keyways therewith.

The top surface 34 of each brick 22 has a plurality of blind bores 48. The plurality of blind bores 48 are generally cylindrically-shaped and are spaced-apart along the top surface 34 of each brick 22.

The bottom surface 35 of each brick 22 has a plurality of blind bores 50. The plurality of blind bores 50 are generally frusto-conical-shaped and spaced-apart along the bottom surface 35 of each brick 22 and are aligned with the plurality of blind bores 48 in the top surface 34 of an associated brick 22.

The brick 22 further has a plurality of alignment pins 52 that align courses. Each alignment pin 52 of the brick 22 has a body portion 54 and a head portion 56. The body portion 54 of the alignment pin 52 of each brick 22 is cylindrically-shaped, is received in an associated blind bore 48 in the top surface 34 of each brick 22, and has a plurality of rings 58. The plurality of rings 58 extend circumferentially around the body portion 54 of the alignment pin 52 of each brick 22, are axially spaced therealong, and compress when the body portion 54 of the alignment pin 52 of each brick 22 is received in the associated blind bore 48 in the top surface 44 of the brick 22 so as to provide a tight fit.

The head portion 56 of the alignment pin 52 of each brick 22 is frusto-conically-shaped, is received in an aligned blind bore 49 in the bottom surface 35 of a brick 22 in a next upper course, and has a plurality of rings 60. The plurality of rings 60 extend circumferentially around the head portion 56 of the alignment pin 52 of each brick 22, are axially spaced therealong, and compress when the head portion 56 of the alignment pin 52 of each brick 22 is received in the aligned blind bore 49 in the bottom surface 35 of the brick 22 in the next upper course so as to provide a tight fit.

Figure 11:
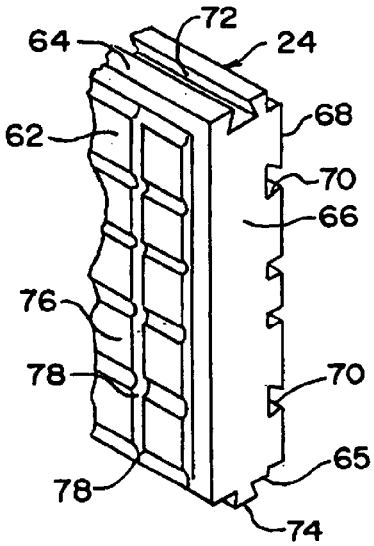
FIG. 11 is a diagrammatic perspective view of the area generally enclosed by the dotted curve identified by arrow 11 in FIG. 10 of the insulation panel of the present invention.
Figure 10:
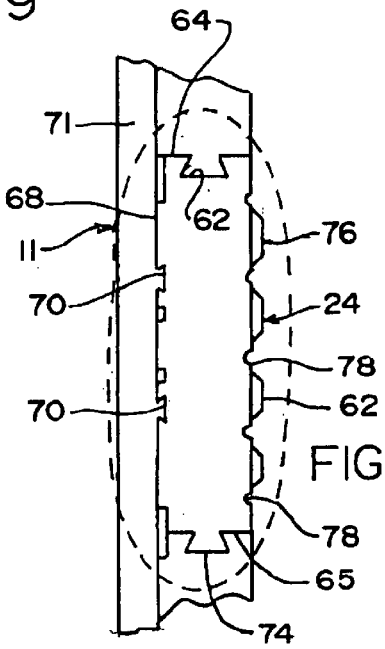
FIG. 10 is a diagrammatic side elevational view of the area generally enclosed by the dotted curve identified by arrow 10 in FIG. 3 of an insulation panel of the present invention with a plaster coat of the present invention applied thereto.

The specific configuration of each insulation panel 24 can best be seen in FIGS. 10 and 11, and as such, will be discussed with reference thereto.

Each insulation panel 24 is styrofoam, and has an exterior side surface 62, a top surface 64, a bottom surface 65, a pair of end surfaces 66, and an interior side surface 68. The exterior side surface 62 of each insulation panel 24, the top surface 64 of each insulation panel 24, the bottom surface 65 of each insulation panel 24, the pair of end surfaces 66 of each insulation panel 24, and the interior side surface 68 of each insulation panel 24 are generally planar.

The interior side surface 68 of each insulation panel 24 has a plurality of dove tail slots 70. The plurality of dove tail slots 70 in the interior side surface 68 of each insulation panel 24 extend horizontally thereacross and are spaced vertically apart and provide keyways for plaster 71 applied to the interior side surface 68 of each insulation panel 24 to grip.

The top surface 64 of each insulation panel 24 has a dove tail slot 72. The dove tail slot 72 extends axially along the top surface 64 of each insulation panel 24.

The bottom surface 65 of each insulation panel 24 has a dove tail projection 74. The dove tail projection 74 extends axially along the bottom surface 65 of each insulation panel 24 and is aligned with, so as to be received by, the dove tail slot 62 in the top surface 64 of an insulation panel 24 in a lower adjacent course.

The exterior side surface 62 of each insulation panel 24 has a plurality of raised panels 76. The plurality of raised panels 76 on the exterior side surface 62 of each insulation panel 24 provide criss-crossed recesses 78 therebetween for the concrete 30 to grip (FIGS. 3 and 4).

Figure 12:
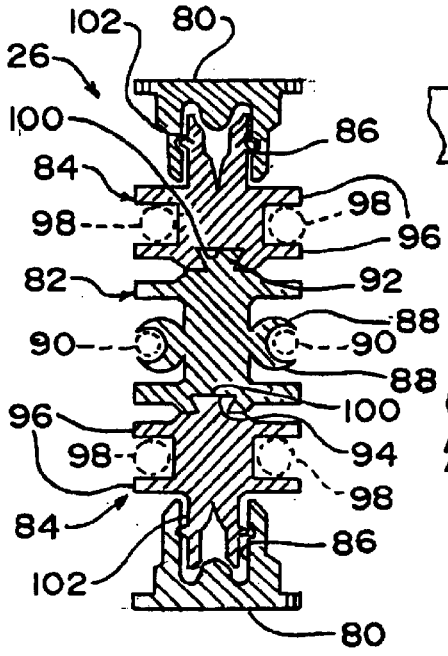
FIG. 12 is an enlarged diagrammatic elevational view of the area generally enclosed by the dotted curve identified by arrow 12 in FIG. 4 of a connector of the present invention.
Figure 13:
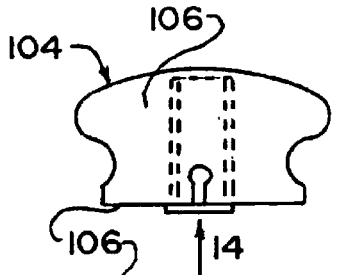
FIG. 13 is an enlarged diagrammatic end view of the area generally enclosed by the dotted curve identified by arrow 13 in FIG. 5A of a cap of the connector of the present invention.
Figure 14:
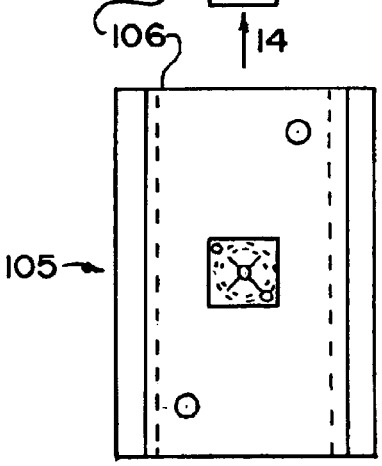
FIG. 14 is a diagrammatic bottom plan view taken generally in the direction of arrow 14 in FIG. 13.

The specific configuration of a connector 26 can best be seen in FIGS. 12–14, and as such, will be discussed with reference thereto.

The connector 26 comprises a pair of end pieces 80, a center piece 82, and a pair of intermediate pieces 84. One end piece 80 attaches to an associated insulation panel 24 and the other end piece 80 attaches to an associated brick 22.

Each end piece 80 of each connector 26 is resilient and has a blind bore 86 extending axially therein so as to form a female coupling.

The center piece 82 of each connector 26 has legs 88 extending radially outwardly therefrom for receiving rebar 90 and a dove tail projection/slot 92 disposed at one end thereof and a dove tail slot/projection 94 disposed at the other end thereof.

Each intermediate piece 84 of each connector 26 has legs 96 extending radially outwardly therefrom for receiving rebar 98 and a dove tail slot/projection 100 disposed at one end thereof engaging the dove tail projection/slot 92,94 on an associated end of the center piece 82 of an associated connector 26 and a male coupling 102 on the other end thereof engaging the blind bore 86 in an associated end piece 80 so as to allow the pair of end pieces 80, the center piece 82, and the pair of intermediate pieces 84 of each connector 26 to be coaxially detachably engaged with each other.

The connector 26 further comprises an end cap 104. The end cap 104 of each connector 26 attaches the one end piece 80 of an associated connector 26 to the aligned brick 22.

The end cap 104 of each connector has a base 105 that is flat and attaches to the one end piece 80 of an associated connector 26 and a head 106 that is bulbous-shaped that extends from the base 105 and engages in a recess 46 in an associated brick 22.

It will be understood that each of the elements described above, or two or more together, may also find a:.useful application in other types of constructions differing from the types described above.

While the invention has been illustrated and described as embodied in a mortarless concrete wall system, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A mortarless concrete wall system, comprising:

a) at least one brick;

b) at least one insulation panel; and c) at least one connector;

wherein said at least one insulation panel is connected to said at least one brick by said at least one connector;

wherein said at least one insulation panel is spaced inwardly from said at least one brick so as to form a space therebetween; and wherein said space is for filling with concrete, wherein each insulation panel is styrofoam;

wherein each insulation panel has an exterior side surface;

wherein each insulation panel has a top surface;

wherein each insulation panel has a bottom surface;

wherein each insulation panel has a pair of end surfaces;

wherein each insulation panel has an interior side surface;

wherein said exterior side surface of each insulation panel is generally planar;

wherein said top surface of each insulation panel is generally planar;

wherein said bottom surface of each insulation panel is generally planar;

wherein said pair of end surfaces of each insulation panel is generally planar; and wherein said interior side surface of each insulation panel is generally planar, wherein said exterior side surface of each insulation panel has a plurality of raised panels;

wherein said plurality of raised panels on said exterior side surface of each insulation panel provides criss-crossed recesses therebetween; and wherein said criss-crossed recesses in said exterior side surface of each insulation panel are for the concrete to grip.

2. The system as defined in claim 1, wherein each brick has an exterior side surface;

wherein each brick has a top surface;

wherein each brick has a bottom surface;

wherein each brick has a pair of end surfaces;

wherein each brick has an interior side surface;

wherein said exterior side surface of each brick is planar;

wherein said top surface of said each is planar;

wherein said bottom surface of each brick is planar;

wherein said pair of end surfaces of each brick is planar; and wherein said interior side surface of each brick is not planar.

3. The system as defined in claim 2, wherein said interior side surface of each brick comprises a plurality of bulbous projections;

wherein said plurality of bulbous projections on said interior side surface of each brick project therefrom by necks that terminate in heads;

wherein said necks of said plurality of bulbous projections on said interior side surface of each brick are concave;

wherein said heads of said plurality of bulbous projections on said interior side surface of each brick are convex;

wherein said heads of said plurality of bulbous projections on said interior side surface of each brick are wider than said necks of said plurality of bulbous projections on said interior side surface of an associated brick so as to form recesses between said necks of adjacent bulbous projections on said interior side surface of said associated brick into which said heads of said plurality of bulbous projections on said interior side surface of said associated brick impinge so as to form keyways therewith; and wherein said recesses between said necks of adjacent bulbous projections on said interior side surface of said associated brick are concave.

4. The system as defined in claim 2, wherein said top surface of each brick has a plurality of blind bores;

wherein said plurality of blind bores in said top surface of each brick are generally cylindrically-shaped; and wherein said plurality of blind bores are spaced-apart along said top surface of each brick.

5. The system as defined in claim 4, wherein said bottom surface of each brick has a plurality of blind bores;

wherein said plurality of blind bores in said bottom surface of each brick are generally frusto-conical-shaped;

wherein said plurality of blind bores are spaced-apart along said bottom surface of said brick; and wherein said plurality of blind bores in said bottom surface of said brick are aligned with said plurality of blind bores in said top surface of an associated brick.

6. The system as defined in claim 4, wherein each brick has a plurality of alignment pins;

wherein said plurality of alignment pins of each brick align courses;

wherein each alignment pin of each brick has a body portion;

wherein each alignment pin of each brick has a head portion;

wherein said body portion of said alignment pin of each brick is cylindrically-shaped;

wherein said body portion of said alignment pin of each brick is received in an associated blind bore in said top surface of an associated brick;

wherein said body portion of said alignment pin of each brick has a plurality of rings;

wherein said plurality of rings extend circumferentially around said body portion of said alignment pin of each brick;

wherein said plurality of rings are axially spaced along said body portion of said alignment pin of each brick; and wherein said plurality of rings of said body portion of said alignment pin of each brick compress when said body portion of said alignment pin of an associated brick is received in said associated blind bore in said top surface of said associated brick so as to provide a tight fit.

7. The system as defined in claim 6, wherein said head portion of said alignment pin of each brick is frusto-conically-shaped;

wherein said head portion of said alignment pin of each brick is received in an aligned blind bore in said bottom surface of a brick in a next upper course;

wherein said head portion of said alignment pin of each brick has a plurality of rings;

wherein said plurality of rings extend circumferentially around said head portion of said alignment pin of each brick;

wherein said plurality of rings are axially spaced along said head portion of said alignment pin of each brick; and wherein said plurality of rings of said head portion of said alignment pin of each brick compress when said head portion of said alignment pin of each brick is received in said aligned blind bore in said bottom surface of a brick of a next upper course so as to provide a tight fit.

8. The system as defined in claim 1, wherein said interior side surface of each insulation panel has a plurality of dove tail slots;

wherein said plurality of dove tail slots in said interior side surface of each insulation panel extend horizontally thereacross;

wherein said plurality of dove tail slots in said interior side surface of each insulation panel are spaced vertically apart;

wherein said plurality of dove tail slots in said interior side surface of each insulation panel provide keyways; and wherein said keyways are for plaster applied to said interior side surface of each insulation panel to grip.

9. The system as defined in claim 1, wherein said top surface of each insulation panel has a dove tail slot; and wherein said dove tail slot extends axially along said top surface of each insulation panel.

10. The system as defined in claim 1, wherein said bottom surface of each insulation panel has a dove tail projection;

wherein said dove tail projection extends axially along said bottom surface of each insulation panel;

wherein said dove tail projection of said bottom surface of each insulation panel is aligned with said dove tail slot in said top surface of an insulation panel in a lower adjacent course; and wherein said dove tail projection of said bottom surface of each insulation panel is received in said dove tail slot in said top surface of an insulation panel in said lower adjacent course.

11. A mortarless concrete wall system, comprising:

a) at least one brick;

b) at least one insulation panel; and c) at least one connector;

wherein said at least one insulation panel is connected to said at least one brick by said at least one connector;

wherein said at least one insulation panel is spaced inwardly from said at least one brick so as to form a space therebetween; and wherein said space is for filling with concrete, wherein each connector comprises a pair of end pieces;

wherein each connector comprises a center piece;

wherein each connector comprises a pair of intermediate pieces; and wherein one end piece attaches to an associated insulation panel and the other end piece attaches to an associated brick, wherein each end piece each connector is resilient; and wherein each end piece of each connector has a blind bore extending axially therein so as to form a female coupling, wherein said center piece of each connector has legs;

wherein said legs of said center piece of each connector extend radially outwardly therefrom;

wherein said legs of said center piece of each connector are for receiving rebar;

wherein said center piece of each connector has a dove tail projection/slot disposed at one end thereof; and wherein said center piece of each connector has a dove tail slot/projection disposed at the other end thereof.

12. The system as defined in claim 11, wherein each intermediate piece of each connector has legs;

wherein said legs of each intermediate piece of each connector extend radially outwardly therefrom;

wherein said legs of each intermediate piece of each connector are for receiving rebar;

wherein each intermediate piece of each connector has a dove tail slot/projection;

wherein said dove tail slot/projection is disposed at one end of each intermediate piece of each connector;

wherein said dove tail slot/projection at one end of each intermediate piece of each connector engages said dove tail projection/slot on an associated end of said center piece of an associated connector;

wherein each intermediate piece of each connector has a male coupling on the other end thereof; and wherein said male coupling on the other end of said intermediate piece of each connector engages said blind bore in an associated end piece so as to allow said pair of end pieces, said center piece, and said pair of intermediate pieces to be coaxially detachably engaged with each other, end-to-end.

13. The system as defined in claim 11, wherein said connector comprises an and cap; and wherein said end cap of each connector attaches said one end piece of an associated connector to said aligned brick.

14. The system as defined in claim 13, wherein said end cap of each connector has a base;

wherein said base of said end cap of each connector is flat;

wherein said base of said end cap of each connector attaches to said one end piece of an associated connector;

wherein said end cap of each connector has a head;

wherein said head of said end cap of each connector is bulbous-shaped;

wherein said head of said end cap of each connector extends from said base of said end cap of said associated connector; and wherein said head of said end cap of each connector engages in a recess in an associated brick.

* * * * *